United States Patent [19]

Ogawa

[11] 4,193,597

[45] Mar. 18, 1980

[54] COMBINATION VEHICLE AND LAUNCHER TOY ASSEMBLY

[75] Inventor: Iwakichi Ogawa, Kashiwa, Japan

[73] Assignee: Takara Co., Ltd., Tokyo, Japan

[21] Appl. No.: 791,568

[22] Filed: Apr. 27, 1977

[51] Int. Cl.[2] ..... A63H 33/06

[52] U.S. Cl. ..... 273/405; 46/17; 46/72; 46/202

[58] Field of Search ..... 46/17, 202, 16, 1 K, 46/1 R, 67, 72, 81, 249, 145, 250, 251; 273/101

[56] References Cited

U.S. PATENT DOCUMENTS

| | | | |
|---|---|---|---|
| 1,565,437 | 12/1925 | Greife | 46/81 X |
| 3,151,866 | 10/1964 | Glass et al. | 46/145 X |
| 3,603,024 | 9/1971 | Davis et al. | 46/1 R X |

FOREIGN PATENT DOCUMENTS

| | | | |
|---|---|---|---|
| N 9615 | 9/1956 | Fed. Rep. of Germany | 46/202 |
| 954764 | 12/1956 | Fed. Rep. of Germany | 46/81 |
| 500834 | 3/1954 | Canada | 46/81 |

*Primary Examiner*—F. Barry Shay

*Attorney, Agent, or Firm*—Jackson, Jones & Price

[57] ABSTRACT

A toy including a number of snap and press-fit parts which may be configured as a race car and may be reassembled to form various other toys. In one such toy, the race car body may be disassembled to form a spring-loaded projectile launcher. Other parts may configure a second vehicle launchable by the projectile launcher. In still another variation, a wheelcover is adapted to be launched as a spinning top.

6 Claims, 9 Drawing Figures

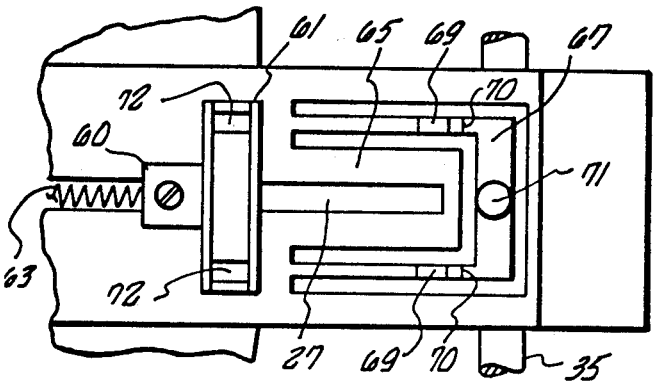
FIG. 2
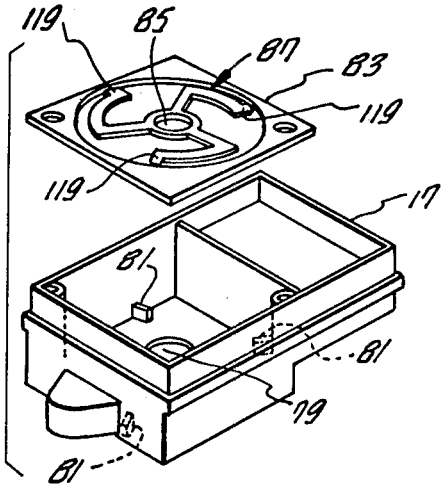
FIG. 5
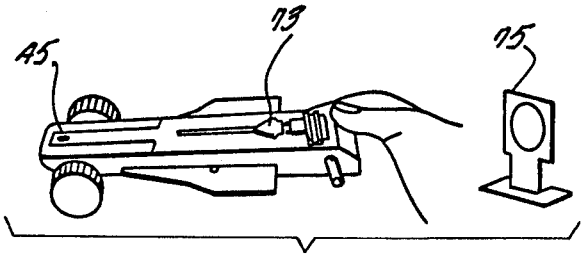
FIG. 3
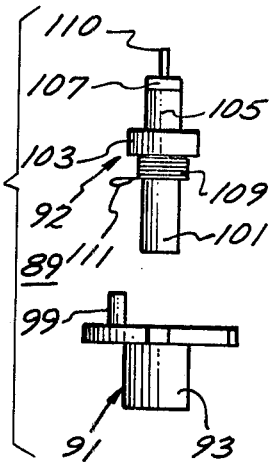
FIG. 6
FIG. 4
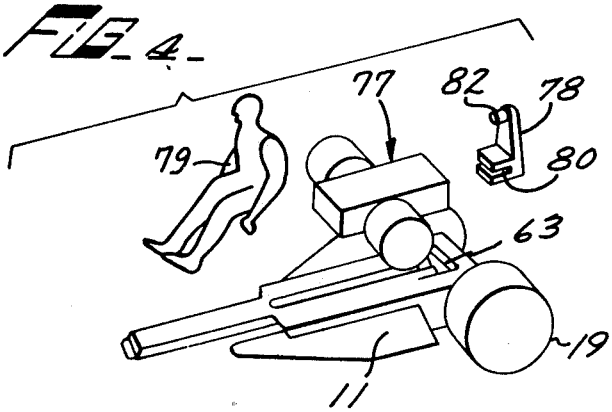
FIG. 7
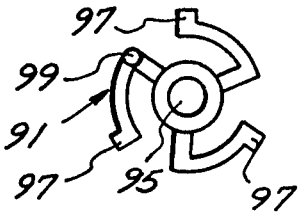
FIG. 8
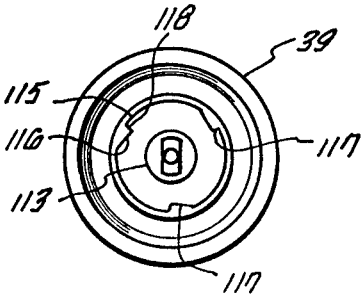
FIG. 9
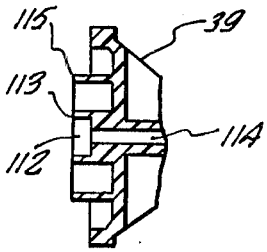

COMBINATION VEHICLE AND LAUNCHER TOY ASSEMBLY

BACKGROUND OF THE INVENTION

1. Field of the Invention

The subject invention relates to toys and more particularly to a toy of reassembleable parts capable of performing multiple toy functions.

2. Prior Art

The prior art has provided familiar toys such as erector sets and other building block toys from which various structures may be configured. However, the prior art has not provided such toys with the diverse toy functions and animated features contemplated by the instant invention. Particularly, the prior art has not provided a toy configurable as a race car which may also provide the functions of a vehicle launcher or a spinning top.

SUMMARY OF THE INVENTION

It is therefore an object of the invention to provide an added degree of sophistication to toys configurable from a number of press-fit and snap-fit attachable parts. It is another object of the invention to provide a number of diverse and stimulating toy functions in such a toy. Particularly, it is an object of the invention to provide a toy configurable as a race car, or as a launcher for projectiles, vehicles or a spinning top.

These and other objects and advantages are achieved according to the invention by a number of elements which may be removably assembled into a race car vehicle. One of the elements contains a spring loaded hammer mechanism which may serve to launch a second vehicle or a projectile. Another of the elements is adapted to serve as a launcher for a top which doubles as a vehicle wheel cover.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 2 is a top view of a launch mechanism of the preferred embodiment of the invention.

FIG. 3 illustrates a perspective of the preferred embodiment of the invention configured as a projectile launcher.

FIG. 4 illustrates the toy of the preferred embodiment of the invention configured as a toy vehicle launcher.

FIG. 5 is an exploded perspective view of the tank element of the preferred embodiment illustrating structure adapting the tank element as a top launching mechanism.

FIG. 6 is a side view of a release button and a drive element on the top launching mechanisms.

FIG. 7 is a top view of the release button.

FIG. 8 is a plan view of a wheel cover.

FIG. 9 is a partial sectional view of a wheel cover element.

DETAILED DESCRIPTION OF THE PREFERRED EMBODIMENT

Figure 1:
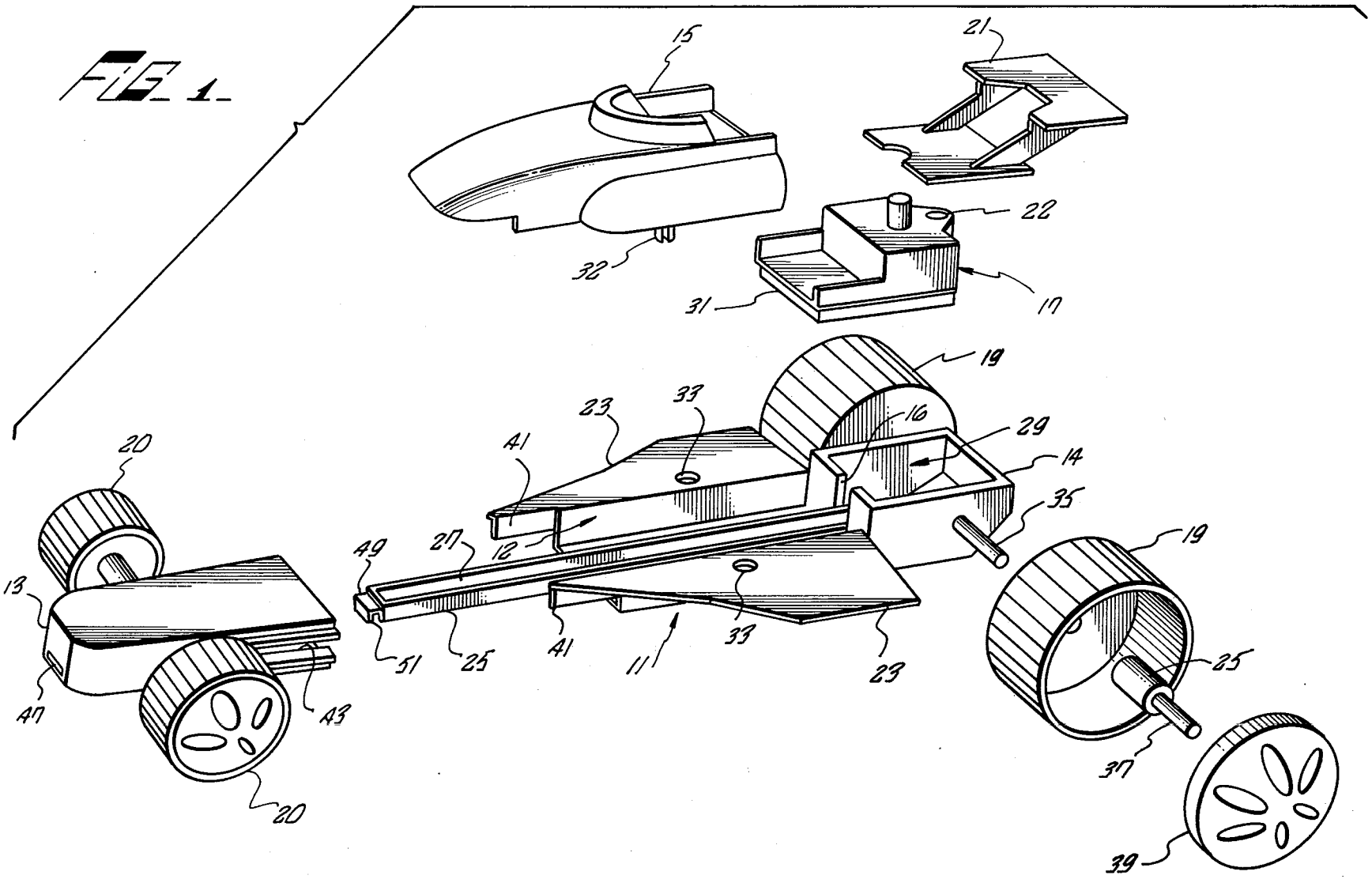
FIG. 1 illustrates in exploded perspective form the toy of the preferred embodiment of the invention with parts arranged to form a vehicle.

The following description is provided to enable any person skilled in the toy industry to make and use the invention and it sets forth the best mode contemplated by the inventor of carrying out this invention. Various modifications, however, will remain readily apparent to those skilled in the above art, since the generic principles of the present invention have been defined herein specifically to provide a relatively economical and easily manufactured combination vehicle and launcher toy assembly.

As illustrated in FIG. 1, various parts of the toy of the preferred embodiment of the invention are attachable to an underframe element 11. These include a wheel-bearing nose member 13, a cockpit cover 15, a tank 17, wheels 19 and a spoiler 21.

The underframe 11, preferably molded integrally of plastic, includes several elements. A channel 12 of rectangular cross-section contains a smaller channel 25 and attaches to two fins or wings 23 and to a tank base 14. The smaller channel 25 is mounted interiorly to the larger channel 12 with its sides parallel to those of the larger channel 12. One end of the smaller channel 25 extends into the tank base 14 via a slot 16 in the base 14. The other end of the smaller channel 25 is closed and bears a tab 49 having a lip 51 formed thereon.

The fins or wings 23 are mounted perpendicularly to the sides of the larger channel 12. Each wing has a circular aperture 33 therein wherein press-fit tabs 32 on the cockpit 15 may be press-fit in order to attach the cockpit 15 to the underframe 11. Each wing 33 also has a rectangular side tab 41 mounted at the front thereof.

The tank base 14 is formed just behind the fins 33. The sides of the tank base 14 rise above the plane of the fins 33 and form a rectangular-rimmed opening 29.

The tank 17 has a rectangular lip 31 formed on its bottom side and a circular aperture 22 formed on its top side. The lip 31 is dimensioned such that the tank 17 may press-fit mount into the rectangular rim of the aperture 29 in the tank base 14. The circular aperture 22 permits press-fit mounting of the spoiler 21 onto the tank 17. The spoiler and tank mounting contributes to the sling-shot racer appearance of the toy.

The wheels 19 rotatably mount on axles 35 formed at the sides of the rectangular opening 29. Each wheel 19 is retained by means of a plug 25 which press-fits on the end of each axle 35. Mounted on each plug 25 is a pin 37 on which a conically shaped wheel cover 39 may be press-fit mounted.

The nose 13, which rotatably mounts first and second wheels 20, slideably mounts onto the underframe 11. Several slots in the nose facilitate this mounting. As seen in FIG. 3, the underside of the nose 13 contains a slot 45 complementary to the smaller channel 25. The nose 13 also has rectangularly shaped apertures 43 at either side thereof. An aperture 47 is formed in the nose 13 to accomodate the tab 49 at the end of the smaller channel 25. To attach the nose member 13, the channel 25 and side tabs 41 are aligned in their proper slots 43, 45 and the nose member 13 is slid onto the channel 25 and the slots 43, 45 until the tab 49 enters the aperture 47 and locks by means of the lip 51.

When the elements shown in FIG. 1 are properly assembled as just described, a toy resembling a slingshot or grand prix race car is formed. As better illustrated in FIG. 2 through FIG. 9, the elements of the preferred embodiment of FIG. 1 may be easily disassembled to form other toys and perform other toy functions. These toys and toy functions will now be explained in greater detail.

FIG. 2 illustrates a launching mechanism formed on the underside of the underframe 11. This device includes a T-shaped hammer 61 which slides in a slot 27 in the small channel 25 and is connected to cock a spring 63 attached at the far end of the channel 25.

A number of cutout portions at one end of the slot 27 enable cocking the hammer 61 and thereafter releasing it. The slot 27 ends in a rigid U-shaped member 65. Attached around the periphery of the U-shaped member 65 is a second U-shaped member 67 having raised ramps 69 and a trigger projection 71 thereon. This second U-shaped member 67 is constructed to be thin and flexible so it may bend in respect to the first U-shaped member 65. The hammer 61 has apertures 72 therein sized to permit entry of the ramps 69.

In operation, the spring 63 is cocked by pulling back the hammer 61. The hammer 61 slides down the slot 27 and proceeds up over the ramps 69 forcing the second U-shaped member 67 down until the back surface of the hammer 61 slides over the ramps 69 such that the hammer 61 is held in position by the engagement of the apertures 72 with the ramps 69. When it is desired to launch, the trigger 71 is depressed removing the abuttment between the back edges 70 of the ramps 69 and the apertures 72, thereby subjecting the hammer 61 to the spring force.

The hammer 61 may be used to perform several launching functions. As FIG. 3 illustrates, the hammer 61 may be used to launch a projectile 73 at a toy target 75. As shown in FIG. 4, the hammer 63 may also be used to launch a vehicle 77 configured from the elements of the preferred embodiment.

In FIG. 4, the nose member 13 serves as the launch vehicle 77 while the underframe 11 serves as the launcher. The rear wheels 19 are retained on the underframe 11 and the underframe 11 is inverted from its position in FIG. 1 such that an angulated launch ramp is formed. The base 60 of the T-shaped hammer 61 is sized to slidably fit into the slot 45 on the underside of the nose member 13. By then mounting the vehicle 77 on the hammer 61 and therafter releasing the hammer 61, the vehicle 77 may be propelled down the launch ramp and across the surface on which the ramp rests.

As further shown in FIG. 4, a mounting member 78 having a press-fit slot 80 and a press-fit plug 82 may also be provided. The press-fit slot permits attachment of the mounting member to the vehicle 77. The plug 82 enables attachment of a toy doll figure 79 to the launch vehicle 77.

As illustrated in FIG. 5 through FIG. 9, the tank member 17 and a wheel cover 39 may be adapted to function as a top, according to the perferred embodiment of the invention. This adaptation will now be discussed in more detail.

As illustrated in FIG. 5, the tank 17 has a hollow interior including a cylindrical opening 79 and three detents 81 spaced 120 degrees apart and extending out from the edges of the tank interior towards the opening 79. A cover 83 is mountable by means of screws (not shown) to the tank 17. The cover 83 has a cylindrical opening 85 concentric with the opening 79 of the tank body 17 and has a ratchet element 87 surrounding the opening 85. The top winding mechansim 89 shown in FIGS. 6, 7 is mounted in the interior of the tank body 17 between the aperture 79 and the cover member 83.

The top winding mechanism 89 includes a release button 91 shown in FIGS. 6 and 7, and a drive element 92 shown in FIG. 6. The release button 91 includes a cap 93 having a cylindrical opening 95 therein. At the base of the cap 93 several projections 97 are formed. These projections 97 interact with the detents 81 in the bottom of the tank body 17 to prevent the cap 93 from rotating when it is in place in the cylindrical opening 79 of the tank body 17. One of the cap projections 97 has a detent 99 depending therefrom.

The drive element 92 includes a first cylinder 101, a cylindrical flange 103 formed at the bottom of the first cylinder 101 and a second cylinder 105 which terminates in a mounting mechanism 107, 110 for the wheel cover 39 shown on FIGS. 8 and 9. The first cylinder 101 of the drive element 92 is slidably and rotatably mountable in the cylindrical opening 95 in the cap 93 of the release button 91. A spring 109 slides over the first cylinder 101 and has a hook 111 which is attached to the detent 99 when the long cylinder 101 is inserted into the cap 93. The flange 103 is of a diameter larger than that of the opening 85 in the tank cover 83 such that the second cylinder 105 and mounting mechanism 107, 110 project through the tank cover opening 87 but are retained in the interior of the tank 17 by the flange 103. When the drive element 92 is mounted in the release button 93 and the hook 111 of the spring 109 is hooked over the detent 99, the drive element 92 may be rotated with respect to the release button 91, which is held stationary by virtue of the detents 81 in the tank housing 17. Such rotation winds the spring 109.

The mounting mechanism of the drive element 92 is configured to releaseably interlock with the hub 113 of the wheel cover 39. In the embodiment illustrated, the mechanism includes an element 107 of rectangular cross-section having a pin 110 mounted at its tip. These two elements 107, 110 fit into complementary apertures 112, 114 in the wheel hub 113.

A cylinder 115, concentric about the hub 113, bears three ramped teeth 117 which cooperate with three flexible projections 119 of the ratchet element 87 on the tank cover 83 to form a ratchet mechanism. This ratchet mechanism functions such that when the wheel hub 113 is inserted into the aperture 85 and mounted on the mounting mechanism 107, 110 the wheel 39 may be rotated in one direction only. That direction is the one wherein the backs 116 of the ramps 117 initially engage the flexible projections 119 and depress them inward. In the opposite direction, where the fronts 118 of the ramps engage the projections 119, no rotation of the wheel 39 is possible.

In operation, the wheel cover 39 is placed onto the mounting mechanism 107, 110 of the drive element 92 and manually rotated to wind-up the spring 109. With the wheel cover 39 in this position, the drive cylinder flange 103 is held a short distance away from the interior rim of the cover aperture 85. The ramp teeth 117 and projections 119 prevent the wheel from rotating in the direction urged by the spring 109. The wheel cover 39 can only be rotated in a direction which imparts additional bias to the spring element 109. When the spring 109 is sufficiently wound, the release button 91 is depressed causing the drive element 92 to move out through the opening 85 and eject the wheel cover 39 from the ratchet mechanism. In this manner, the drive element 92 is allowed to spin until the spring bias is spent. The spinning of the drive element 92 is imparted to the conically shaped wheel cover 39, which subsequently spins off the drive element 92 and performs a familiar spinning top function.

The preferred embodiment of the invention thus provides an action-packed toy, which is in itself a plurality of toys. As may be appreciated, many adaptations and modifications may be made in the preferred embodiment just described without departing from the scope and spirit of the invention. Therefore, it is to be understood that, within the scope of the appended claims, the invention may be practiced other than as specifically described herein.

What is claimed is:

1. A plurality of toy elements comprising:

first means including a plurality of removably attachable elements for forming a first vehicle, the elements including a nose element detachable from the first vehicle;

second means configurable from said first means for forming an ejection device, said second means comprising hammer means slideably mounted in a first said element, means for biasing said hammer means toward a first position, and means for retaining said hammer means in a position displaced against said bias and for releasing said hammer means such that said bias force returns said hammer means to said first position, the ejection device adapted to secure the nose element and launch the nose element when the nose element is detached from the first vehicle, and third means configurable from said first means for forming a top spinning and launching mechanism and for forming a mounting for said mechanism.

2. The toy of claim 1 further including a toy target and projectiles adapted to be launched at said target by said ejection device.

3. The toy of claim 1 wherein said hammer means includes first and second apertures, and said retaining means comprises:

4. The toy of claim 1 wherein said top spinning and launching mechanism comprises:

a top configured from a second element of said first vehicle forming means; and wherein said third means for forming said top spinning and launching mechanism is in a third element of said first means and includes means for retaining said top, for permitting said top to be wound against spring bias and for releasing said top while at the same time importing the wound bias to said top to cause said top to spin.

5. The toy of claim 4 wherein said means in the third element comprises:

first and second concentric apertures in said third element;

a drive element having an activating button means extending out of said first aperture and a mounting means for said top extending out of said second aperture, and further including means for holding said button means in position while winding said mounting means against spring bias; and ratchet means for allowing said top to be wound in a direction increasing said spring bias while preventing said toy from spinning in the direction urged by said bias.

6. A toy comprising:

a frame member adapted to mount first and second wheels;

means mounted in said frame member for launching objects;

nose member means removably attachable to said frame member and having third and fourth wheels, said nose member means being adapted for launching by said means for launching;

first and second wheels for attachment to said frame member;

first and second conically-shaped wheel covers;

tank means press-fit attachable to said frame member; and means located in said tank means for imparting a spinning-top motion to said wheel cover and for launching it as a top in response to manual actuation.

* * * * *

UNITED STATES PATENT AND TRADEMARK OFFICE

CERTIFICATE OF CORRECTION

PATENT NO. : 4,193,597

DATED : March 18, 1980

INVENTOR(S) : Iwakichi Ogawa

It is certified that error appears in the above—identified patent and that said Letters Patent is hereby corrected as shown below:

In Column 5, line 40, after "comprises:" insert the following:

--a rigid U-shaped member having a slot therein in which said hammer means slides; and a flexible U-shaped member means encompassing said rigid U-shaped member and having first and second ramps thereon for releasably interlocking with the apertures of said hammer means.--

Signed and Sealed this

*Fifth* Day of *August 1980*

[SEAL]

*Attest:*

SIDNEY A. DIAMOND

*Attesting Officer*

*Commissioner of Patents and Trademarks*